US005937803A

United States Patent [19]

Murata

[11] Patent Number: 5,937,803

[45] Date of Patent: Aug. 17, 1999

[54] ENGINE CYLINDER BLOCK

[75] Inventor: Satoshi Murata, Yokohama, Japan

[73] Assignee: Nissan Motor Co., Ltd., Yokohama, Japan

[21] Appl. No.: 09/041,464

[22] Filed: Mar. 12, 1998

[30] Foreign Application Priority Data

Mar. 12, 1997 [JP] Japan ..... 9-057760

[51] Int. Cl.[6] ..... F01P 3/02

[52] U.S. Cl. ..... 123/41.74

[58] Field of Search ..... 123/41.72, 41.74, 123/41.81

[56] References Cited

FOREIGN PATENT DOCUMENTS 2-153249 6/1990 Japan .

*Primary Examiner*—Noah P. Kamen
*Attorney, Agent, or Firm*—Foley & Lardner

[57] ABSTRACT

In a water-cooled engine cylinder block, a lower end of a water jacket outer wall and a cylinder wall are joined by a water jacket base wall, and coolant is led into a space formed by the cylinder wall, water jacket base wall and water jacket outer wall. A bend part having a crank shape cross-section is formed in the water jacket base wall. As a result, the rigidity of the water jacket base wall decreases so that transmission of the axial tension of the head bolt to the cylinder wall is suppressed, and deformation of the cylinder wall is suppressed.

5 Claims, 4 Drawing Sheets

ENGINE CYLINDER BLOCK

The contents of Tokugan Hei P9-57760, with a filing date of Mar. 12, 1997 in Japan, are hereby incorporated by reference.

FIELD OF THE INVENTION

This invention relates to improvement of a cylinder block of a water-cooled engine.

BACKGROUND OF THE INVENTION

As shown in Tokkai Hei 2-153249 published in 1990 by the Japanese Patent Office, a cylinder block of a water-cooled engine comprises a water jacket around a cylinder wall, and the heat of the cylinder wall is absorbed by circulating a coolant through this water jacket.

In one type of engine cylinder block, a waterjacket base wall is connected at a point midway along the cylinder wall, and the waterjacket is formed only around the upper part of the cylinder wall. In this way excessive cooling of the cylinder wall is prevented, warm up is promoted, and exhaust performance and heater performance are improved.

When the water jacket base wall is connected midway along the cylinder wall in this way however, the axial tension of a head bolt generated when the head bolt is tightened or when a combustion pressure is input, is transmitted to the middle part of the cylinder wall from a head bolt boss via the water jacket base wall. As a result, a deformation of the cylinder wall increases causing scuffing of the cylinder bore, or increase of lubricating oil consumption may increase.

SUMMARY OF THE INVENTION

It is therefore an object of this invention to suppress transmission of the axial tension of a head bolt to a cylinder wall, and thereby to suppress deformation of the cylinder wall.

In order to achieve the above object, this invention provides a water-cooled type engine cylinder block comprising a cylinder wall, a water jacket outer wall covering the cylinder wall with a clearance, and a water jacket base wall connecting the lower end of the water jacket with of the cylinder wall, wherein coolant is led into a space formed by the cylinder wall, the water jacket base wall and the water jacket outer wall. The water jacket base wall has a bent part having a crank shape vertical cross-section.

According to an aspect of this invention, the water jacket outer wall comprises a head bolt boss into which a head bolt is screwed, and the bent part is formed below the lower end of the head bolt boss.

According to yet another aspect of this invention, intervals between the bends of the bent part are set to become larger as the cylinder wall is approached.

According to yet another aspect of this invention, a thickness of a part of the cylinder wall to which the water jacket base wall is connected is set to be larger than the thickness of other parts of the cylinder wall.

According to yet another aspect of this invention, a thickness of the cylinder wall progressively increases from an upper end to a part to which the water jacket base wall is connected.

The details as well as other features and advantages of this invention are set forth in the remainder of the specification and are shown in the accompanying drawings.

DESCRIPTION OF THE PREFERRED EMBODIMENTS

Figure 1:
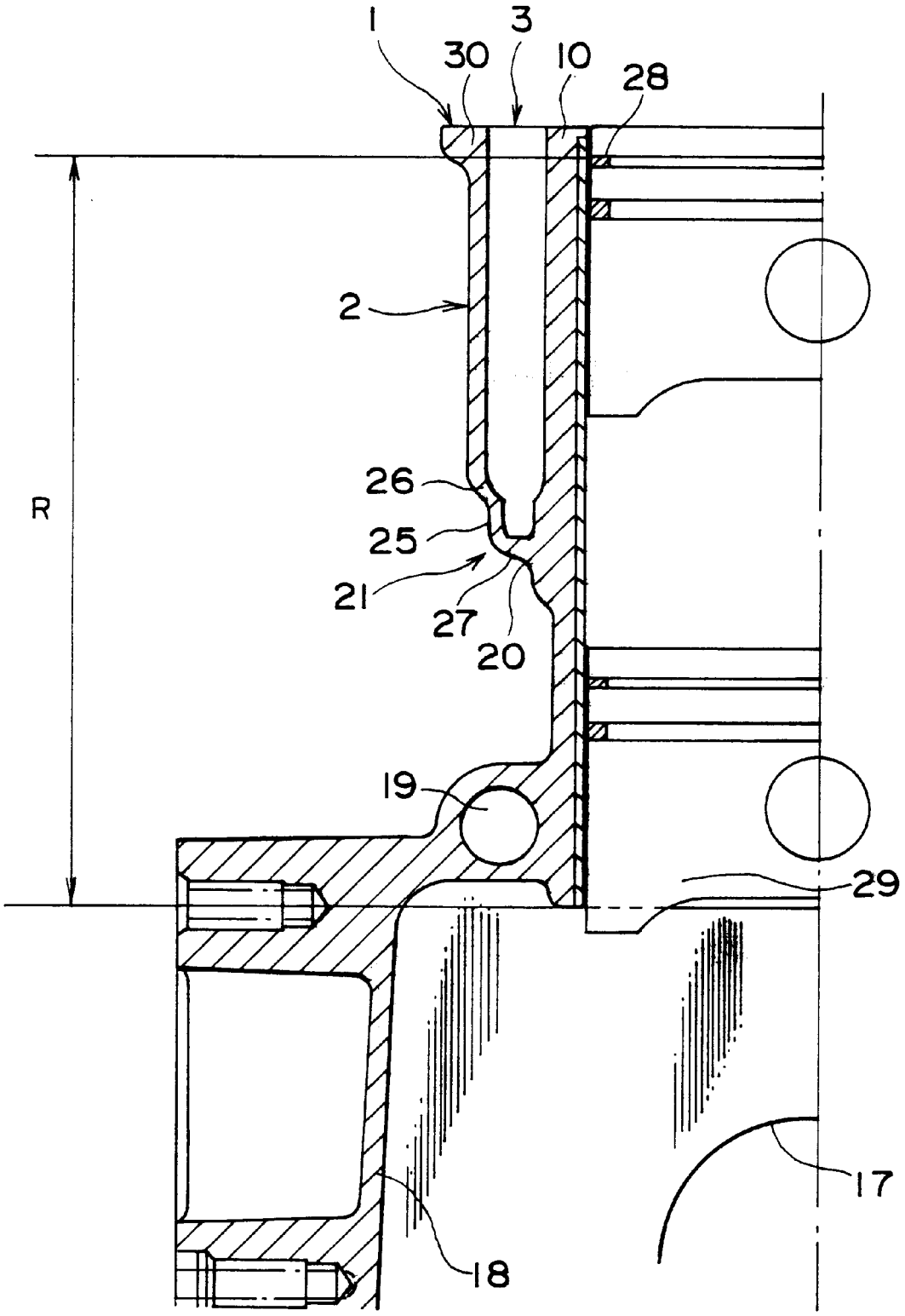
FIG. 1 is a partial cross-sectional view of a cylinder block according to a first embodiment of this invention taken through a cylinder.

Referring to FIG. 1 of the drawings, a cylinder block 1 comprises a water jacket 2 outside a cylinder wall 10 housing a piston which is free to slide. The water jacket 2 comprises a water jacket outer wall 30 covering an upper part of the cylinder wall 10 with a certain clearance, and a water jacket base wall 20 joining the water jacket outer wall 30 to the cylinder wall 10 within a piston reciprocating range R. The piston reciprocating range R is defined between a compression ring 28 at the top dead center position of the piston and the bottom of a piston skirt 29 at the bottom dead center position of the piston. Coolant is led into a space formed by the cylinder wall 10, waterjacket base wall 20 and water jacket outer wall 30.

The cylinder block 1 is of the open deck type wherein the upper end of the water jacket 2 is open. The cylinder block 1 is formed of aluminum alloy by die-casting in a mold. The cylinder block 1 also comprises a beating 17 for supporting a crankshaft, not shown, a crankcase 18 and an oil gallery 19.

Coolant sent from a water pump, not shown, passes through the water jacket 2 and is circulated around the cylinder wall 10. This coolant flows into a water jacket from an upper end opening 3 of the water jacket 2 in a cylinder head via a through hole while absorbing the heat of the cylinder wall 10, and it also absorbs the heat of the cylinder head.

Figure 2:
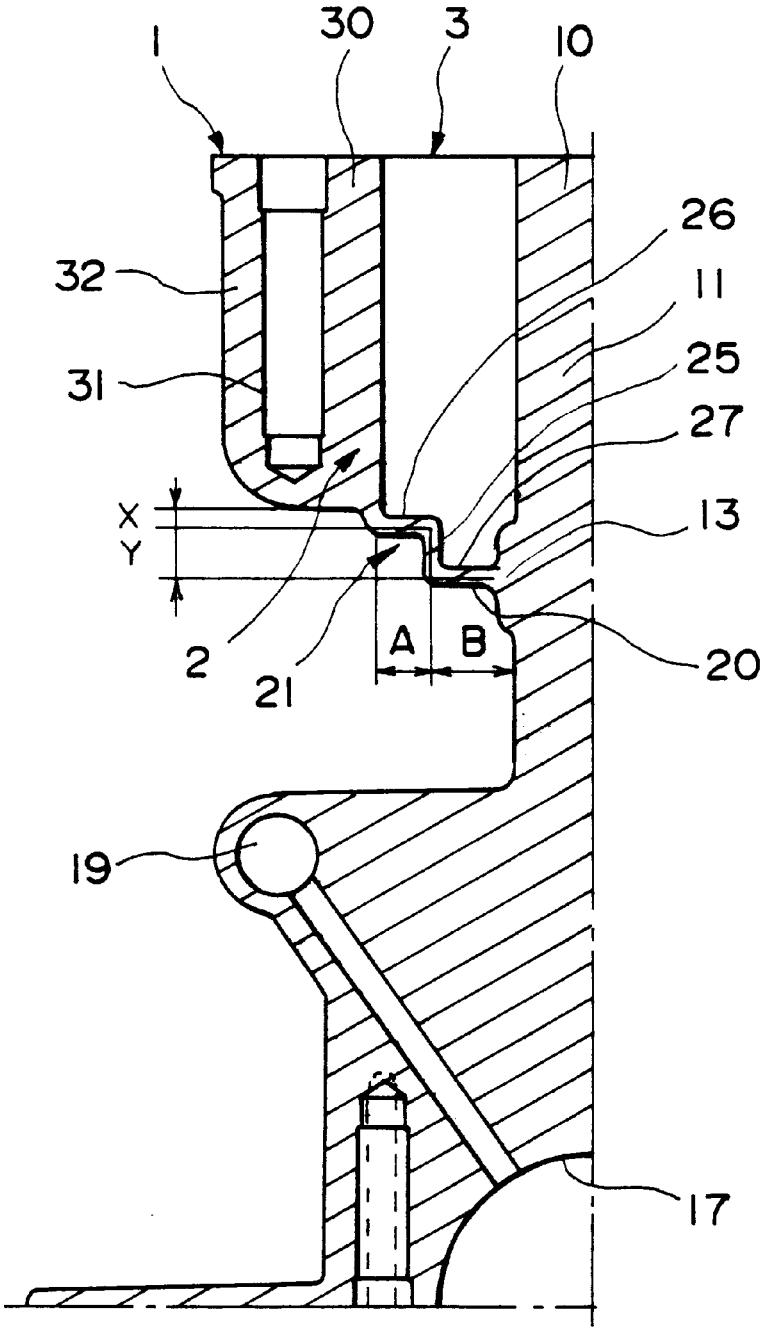
FIG. 2 is a partial cross-sectional view of the cylinder block according to the first embodiment of this invention taken through a part between cylinders.

The cylinder block 1 has a junction 11 where the walls 10 of neighboring cylinders adjoin each other as shown in FIG. 2. The cylinder walls 10 are arranged to be as close to each other as possible to reduce the overall length of the engine.

A head bolt boss 32 is formed in the water jacket outer wall 30 so as to provide a screw hole 31 for screwing in a head bolt. The head bolt bosses 32 are arranged between the cylinders and at the ends of the cylinders.

A bent part 21 is provided in the jacket base wall 20. The cross-section of the bent part 21 is that of a crank with two bends. More specifically, the cross-section of the bent part 21 has a vertical wall 25 substantially parallel to the cylinder wall 10, and horizontal walls 26, 27 which bend away from the upper and lower ends of the vertical wall 25 such that they are substantially perpendicular to it. The outer circumferential edge of the horizontal walt 26 bends upwards at approximately 90 degrees, and connects with the lower end of the water jacket outer wall 30. The inner circumferential edge of the horizontal wall 27 connects with the cylinder wall 10 from a horizontal direction.

The bent part 21 is formed at a distance X from the lower end of the head bolt boss 32, as shown in FIG. 2. There are gaps X, Y between the bends of the bent part 21 in a vertical direction, Y which is closer to the cylinder wall 10 being set larger than X. There are gaps A, B between the bends of the bent part 21 in a horizontal direction, B which is closer to the cylinder wall 10 being set larger than A.

The cylinder wall 10 is formed so that the wall thickness of the part where the water jacket base wall 20 connects with it, is larger than the wall thickness of other parts. Specifically, a convex part 13 extends like a belt around the outer circumference of the cylinder wall 10, and the inner circumferential edge of the water jacket base wall 20 connects substantially with the center of this convex part 13.

According to this embodiment, the rigidity of the water jacket base wall 20 is low due to the bent part 21 formed in the water jacket base wall 20. This suppresses transmission of the axial tension of the head bolt which is generated when the head bolt is tightened or when a combustion pressure is input, to the cylinder wall 10 from the head bolt boss 32 via the water jacket outer wall 30 and the water jacket base wall 20, hence deformation of the cylinder wall 10 is suppressed. In other words, the relative displacement of the head bolt boss 32 relative to the cylinder wall 10 due to the axial tension variation of the head bolt, is absorbed by the elastic deformation of the bent part 21 of the water jacket base wall 20, and this suppresses deformation of the cylinder wall 10.

The bent part 21 is formed at a distance X from the lower end of the head bolt boss 32, deformation of the water jacket base wall 20 is promoted, which also suppresses deformation of the cylinder wall 10.

Of the vertical intervals X, Y between the bends of the bent part 21, Y which is closer to the cylinder wall 10 is set larger than X, thereby promoting deformation of the bent part 21 and suppressing transmission of the axial tension of the head bolt to the cylinder wall 10.

Of the vertical intervals A, B between the bends of the bent part 21, B which is closer to the cylinder wall 10 is set larger than A, again thereby promoting deformation of the bent part 21 and suppressing transmission of the axial tension of the head bolt to the cylinder wall 10.

Also, due to the convex part 13 which extends like a belt around the outer circumference of the cylinder wall 10, the thickness of the part of the cylinder wall 10 to which the water jacket 20 is connected is larger, and the rigidity of the cylinder wall 10 is therefore effectively increased where it is under stress from the water jacket base wall 20. This permits the average thickness of the cylinder wall 10 to be made smaller, and the engine to be made more lightweight.

Due to the fact that the structure of the cylinder wall 10 does not easily deform, scuffing of the cylinder bore is suppressed, friction of the piston is reduced, and engine fuel consumption is reduced. Further, as the gap between the cylinder wall 10 and the piston is uniform, less lubricating oil leaks from this gap into the crankcase and oil consumption is reduced.

By forming the bent part 21 in the water jacket base wall 20, the flowpath cross-sectional area of the lower part of the water jacket 2 is made smaller, which increases the amount of coolant circulating through the upper part of the water jacket 2. Due to this, the cooling of the upper part of the cylinder wall 10 which is exposed to combustion gas is enhanced, and the temperature distribution of the cylinder wall 10 is made uniform.

Figure 3:
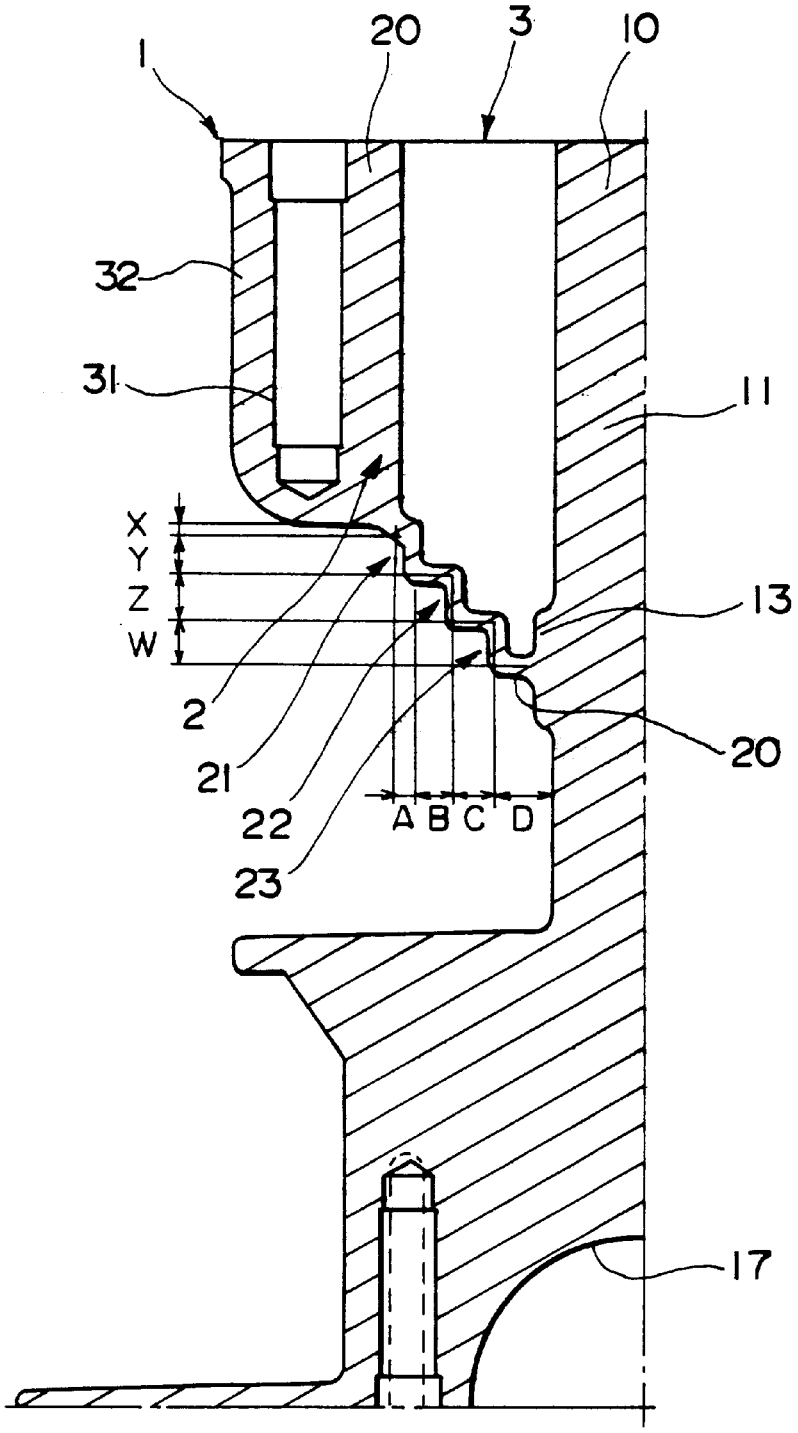
FIG. 3 is similar to FIG. 2, but showing a second embodiment of this invention.

FIG. 3 shows a second embodiment of this invention. In this embodiment, the water jacket base wall 20 has three bent parts 21,22,23 each of which has a crank shape vertical cross-section.

The intervals X, Y, Z, W in a vertical direction between the bends of the bent parts 21, 22, 23 are set to be larger as the cylinder wall 10 is approached (X<Y<Z<W).

The intervals A, B, C, D in a horizontal direction between the bends of the bent parts 21, 22, 23 are also set to be larger as the cylinder wall 10 is approached (A<B<C<D).

According to this embodiment, deformation of the bent parts 21, 22, 23 is promoted, and the deformation is dispersed among the bent parts.

Figure 4:
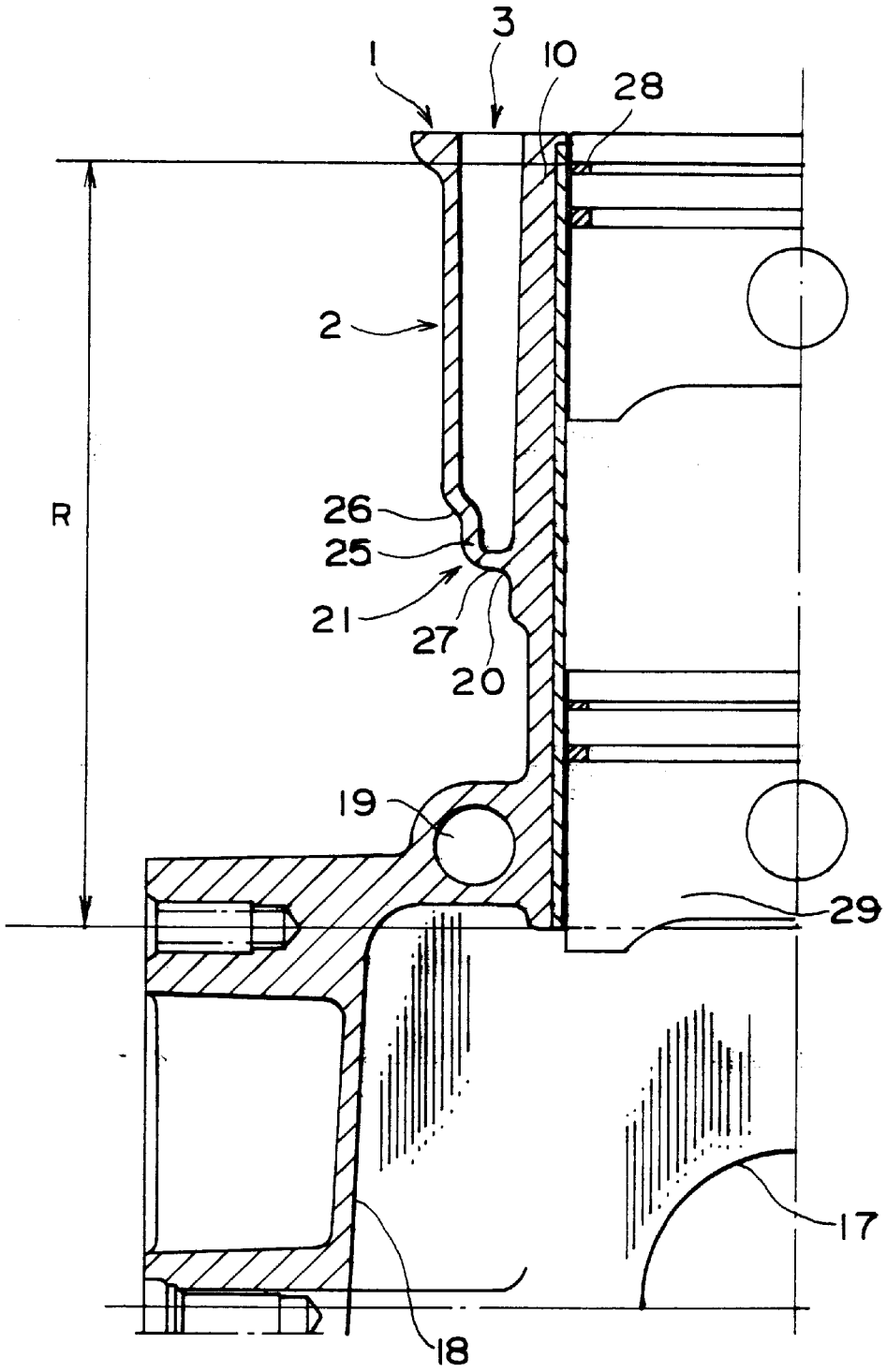
FIG. 4 is similar to FIG. 1, but showing a third embodiment of this invention.

FIG. 4 shows a third embodiment of this invention. The cylinder wall 10 in the cylinder block 1 shown in this embodiment is formed in a taper shape. The thickness of the cylinder wall 10 becomes progressively larger starting from the upper end towards a part where it comes in contact with the water jacket base wall 20.

Since the thickness of the cylinder wall 10 is larger in the part where it comes in contact with the water jacket base wall 20 according to this embodiment, the rigidity of the cylinder wall 10 is increased where it comes under stress from the waterjacket base wall 20. As a result, the average thickness of the cylinder wall 10 can be made smaller, and the engine can be made more lightweight.

The mold used to form the water jacket 2 is pulled out in an upward direction during casting of the open deck type cylinder block 1, and since the mold used to form the water jacket 2 has a taper shape, demolding is easy to perform so that productivity of cylinder blocks is increased.

As the cylinder wall 10 is formed in a taper shape, the flowpath cross-sectional area of the lower part of the water jacket 2 is smaller, and the amount of coolant circulating through the upper part of the waterjacket 2 is thereby increased. Due to this, the cooling of the upper part of the cylinder will 10 which is exposed to combustion gas is increased, and the temperature distribution of the cylinder wall 10 is made uniform.

The embodiments of this invention in which an exclusive property or privilege is claimed are defined as follows:

1. A water-cooled type engine cylinder block comprising:

a cylinder wall, a water jacket outer wall covering said cylinder wall with a clearance, and a water jacket base wall connecting the lower end of said water jacket with said cylinder wall, said water jacket base wall having a bent part having a crank shaped vertical cross-section, wherein coolant is led into a space formed by said cylinder wall, said water jacket base wall and said water jacket outer wall.

2. A water-cooled engine cylinder block as defined in claim 1, wherein said water jacket outer wall comprises a head bolt boss into which a head bolt is screwed, and said bent part is formed below the lower end of said head bolt boss.

3. A water-cooled engine cylinder block as defined in claim 1, wherein intervals between the bends of said bent part are set to become larger as said cylinder wall is approached.

4. A water-cooled engine cylinder block as defined in claim 1, wherein a thickness of a part of said cylinder wall to which said water jacket base wall is connected is set to be larger than the thickness of other parts of said cylinder wall.

5. A water-cooled engine cylinder block as defined in claim 1, wherein a thickness of said cylinder wall progressively increases from an upper end to a part to which said water jacket base wall is connected.

* * * * *